United States Patent [19]

Allanic et al.

[11] 4,043,029

[45] Aug. 23, 1977

[54] WAVEGUIDE AND PROCESS FOR MAKING THE SAME

[75] Inventors: Jacques Allanic, Sceaux; Guerchon Georges Fuchs, Paris, both of France

[73] Assignees: Societe Anonyme de Telecommunications; Etat Francais represente par le Secretaire des Postes et Telecommunications (Centre National D'Etudes des Telecommunications), both of France

[21] Appl. No.: 644,146

[22] Filed: Dec. 24, 1975

[30] Foreign Application Priority Data

Jan. 17, 1975 France ..... 75.01430

[51] Int. Cl.[2] ..... H01P 11/00; H01P 3/12

[52] U.S. Cl. ..... 29/600; 29/728; 333/95 R

[58] Field of Search ..... 29/600, 601, 202.5, 29/163.5 CN; 72/135, 367, 368, 370; 264/173, 272; 425/500, 518, 114, 324 R, DIG. 200, DIG. 201; 333/95 R, 96, 97 R, 98 R, 33; 57/9; 156/50, 51, 54, 56

[56] References Cited

U.S. PATENT DOCUMENTS

| | | | |
|---|---|---|---|
| 3,023,300 | 2/1962 | Lehnert | 29/202.5 X |
| 3,529,340 | 9/1970 | Polizzano et al. | 29/202.5 |
| 3,605,046 | 9/1971 | Miller | 29/600 X |
| 3,769,697 | 11/1973 | Priaroggia et al. | 29/600 |
| 3,779,846 | 12/1973 | Kleykamp et al. | 72/135 X |
| 3,952,407 | 4/1976 | Aupoix et al. | 29/600 |

FOREIGN PATENT DOCUMENTS

| | | | |
|---|---|---|---|
| 1,810,936 | 11/1968 | Germany | 29/600 |
| 4,516,150 | 1/1967 | Japan | 29/600 |

*Primary Examiner*—VictorA. DiPalma
*Attorney, Agent, or Firm*—Jacobs & Jacobs

[57] ABSTRACT

A process for the manufacture of a circular helix waveguide comprising a helically wound insulated metallic wire covered with a barrier layer and forming a wound and wrapped structure itself covered by a metallic screen, wherein a metal band is shaped into a tube, the contiguous edges of the said band are welded by a high frequency current in such a way that after welding the internal diameter of the shaped tube is a few millimeters greater than the external diameter of the wound and wrapped structure, the said tube is placed around the said structure, then the said tube is shaped into a cylinder with a circular base on the said structure to constitute the said metallic screen.

5 Claims, 1 Drawing Figure

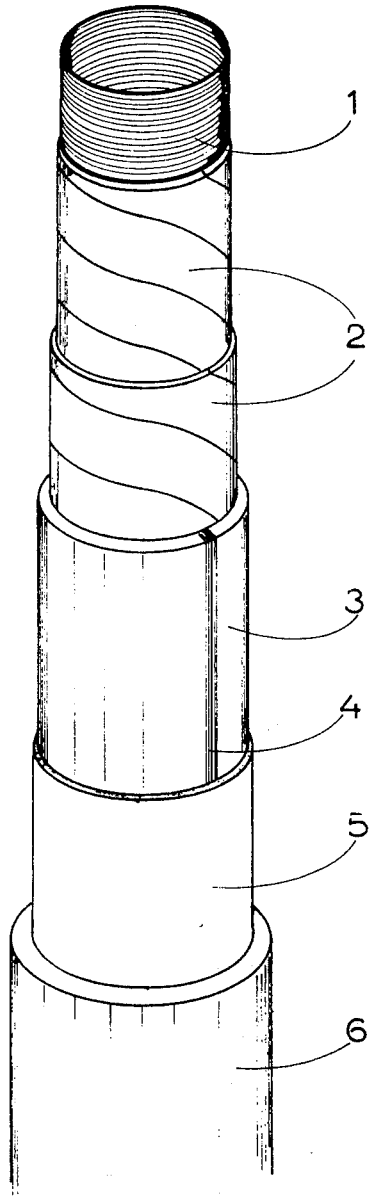
1
2
3
4
5
6

WAVEGUIDE AND PROCESS FOR MAKING THE SAME

The present invention relates to circular helix waveguides for the transmission of waves of the $TE_{01}$ mode.

It is known that waveguides of this type are formed by an insulated metal wire helically wound with contiguous turns onto a mandrel with a great dimensional precision, whereby simultaneously bands of glass-fibre web forming a barrier layer whose thickness is roughly a quarter of the average wavelength to be transmitted on the guide, are placed on the thus obtained helical winding. Still forming part of the same operation, the barrier layer is covered with a metal screen for which different solutions have been envisaged, including the use of a fine meshed wire gauze tape or a helically would thin metallic tape. To provide at this level of the barrier to prevent water penetrating into the waveguide, it has also been proposed to form the screen by a thin metal tube sealed longitudinally by means of clips or by welding.

These different constructional forms lead to a substantially deformable wound structure which must be transversely and longitudinally rigidified, it being well known that the stability of the transmission conditions increases proportionately to the decrease in the tendency of the waveguides to deform.

A first method consists of helically winding onto a metallic screen a plurality of fibre-glass tape layers and impregnating the thus obtained assembly with a polymerisable resin. This method is particularly used when the screen is formed by a thin wire gauze.

A second method which is particularly used when the screen is formed by a helically wound thin metallic tape consists of extruding a relatively thick thermoplastic sheath around the said screen as described in French Pat. No. 7,201,783.

Finally, a third method used when the screen is formed by a longitudinally sealed metal tube consists of corrugating the said screen to give it an acceptable transverse rigidity as is also described in French Pat. No. 7,201,783.

It can be seen that the performance of the first method is necessarily costly and complicated, whereby the resin polymerisation time significantly increases the manufacturing period.

The second method has the disadvantage of only giving a mediocre longitudinal rigidity to the waveguide. Moreover, due to the thinness of the metallic screen there is a danger of the reduction of the regularity of the internal diameter of the waveguide due to the thermal and mechanical stresses produced during the extrusion of the thermoplastic sheath.

Due to the presence of the corrugations on the metallic screen in the third method proposed, it has the disadvantage of giving the waveguide no longitudinal rigidity because it on the contrary aids its pliability.

The present invention aims at obviating the disadvantages of the known waveguides by means of a new manufacturing process permitting the obtention of a high precision of the screen.

To this end the invention has for its object a process for the manufacture of a circular helix waveguide according to which a metal band is shaped into a tube, the contiguous edges of the said band are welded by a high frequency current in such a way that after welding the internal diameter of the shaped tube is a few millimeters greater than the external diameter of the wound and wrapped structure, the said tube is placed around the said structure, then the said tube is shaped into a cylinder with a circular base on the said structure to constitute the said metallic screen.

The process according to the invention ensures on the one hand a longitudinal and transverse rigidity of the helical winding with contiguous turns, and on the other a dimensional precision of the screen and which is equivalent to that obtained on the winding. This avoids any frequency limitation and ensures a better electrical transmission due to a precision on the external diameter of the screen and a constant and homogeneous flexibility of the tube, particularly at bends which aids attenuation.

It is also pointed out that high frequency welding permits the use of a semi-hard aluminium, i.e. with an appropriate elastic limit.

Preferably the screen comprises a metal tube having a thick wall with an adequate mechanical strength enabling it to give appropriate longitudinal and transverse rigidity to a waveguide element of given length which in advantageous manner obviates any subsequent reinforcing operations for the screened wound structure.

According to the invention, the screen metal whilst being a good conductor of electricity is chosen in such a way as to have a sufficiently high elastic limit so that a waveguide element of given length (generally between 10 and 15 meters) whose ends are placed on two supports can undergo no permanent deformation due to its own weight. This condition in itself guarantees the permanent non-deformability of the waveguide during the short subsequent manipulations.

As a non-limitative example, it is pointed out that a screen made from a conventional aluminium of commercial quality and of adequate hardness, i.e. whose elastic limit is at least equal to 7 hbars with a thickness of 1.2 mm, can easily fulfil the above-mentioned rigidity conditions for a waveguide having an internal diameter of 50 mm and a length of 10 m.

To improve the resistance to accidental shocks of the thus obtained waveguide and, at the same time, to protect it against corrosion, the metal screen can in per se known manner be covered with a bitumen layer and an extruded thermoplastic sheath without there being any fear on this occasion of any deterioration of the regularity of the inner wall of the winding due to the intrinsic mechanical strength of the said screen.

The invention will be better understood from reading the following description of a preferred embodiment of the waveguide according to the invention with reference to the attached drawing which shows a schematic perspective view of the waveguide.

The waveguide comprises a helical winding 1 which can comprise an insulated copper wire of diameter approximately 0.5 mm, a barrier layer 2 advantageously formed from one or more tapes made from an adhesive plastic material such as, for example, two ethylene terephthalate adhesive tapes whose thickness regularity guarantees a very precise external diameter for the wound wrapped structure, a metal screen 3 welded along a generatrix 4, a bitumen protective layer 5 and an extruded thermoplastic sheath 6.

According to the invention, screen 3 is made from a metallic band of considerable length, e.g. a hard or semi-hard aluminium band whose very regular thickness does not vary by more than 0.005 mm. This band is shaped into a cylinder by passing through a shaping bench in such a way as to transform it into a continuous tube open along its upper generatrix. According to the invention, in the same operation the edges of the tube are brought together and welded by forging along the generatrix 4 by using a high frequency current welding process which has the advantage of only locally heating the metal and therefore only impairing its initial hardness slightly adjacent to the welded generatrix. The width of the aluminium band is chosen in such a way that the thus obtained tube has an internal diameter which is a few millimetres larger than the external diameter of the wound and wrapped structure. The tube is then cut into elements whose length corresponds to that of the waveguides required, followed by deburring and cleaning.

As it is being manufactured the wound and wrapped structure is introduced into the tube element at the outlet from the winding machine. When the length of the structure obtained is equal to that of the metal tube, the latter is passed through an appropriately lubricated circular spineret which shapes the same. The geometrical characteristics of the shaping spineret are determined in such a way that the nominal internal diameter of the thus obtained metallic screen is a few hundredths of a millimeter larger than the nominal external diameter of the wound and wrapped structure in order to take account of any possible thickness increases of the materials forming the waveguide at this stage of its manufacture.

As stated hereinbefore the waveguides can then be covered with a bitumen layer and a thermoplastic sheath which give them an additional protection.

It should be noted that the transmission qualities of the waveguides according to the invention are much higher than those of the prior art waveguides.

In preferred manner the thickness ($e$) of the screen 3 can be determined by the equation:

$$e \geqq \frac{K}{\frac{R_\rho}{TC} - \rho}$$

in which $K = 1/\pi \times \psi/d$, $\psi$ being the weight of the wound structure per millimeter, $R_\rho$ is the elastic limit of the screen metal, $C$ is a safety factor above 1, $T = L^2/2d$ is a characteristic of the screen dimensions, L being the manufactured length and $d$ the internal diameter of the screen and $\rho$ the specific mass of the screen metal.

This relationship is not homogeneous and K and T are only characteristics involved in the determination of the thickness.

What we claim is:

1. A method for the manufacture of a circular waveguide having an inner wall formed by a helically wound insulated metallic wire covered with a wound and wrapped barrier layer which barrier layer is in turn covered by a cylindrical metallic screen of sufficient longitudinal and transverse rigidity as to render the waveguide self supportive, which comprises winding said metallic wire into a helix and covering said helix with said wound and wrapped barrier layer, separately forming a metal band into a tubular cross section and joining the contiguous edges of the band by high frequency welding, the internal diameter of the shaped and welded tube being a few millimeters greater than the external diameter of the wound and wrapped helix, positioning said tube around said wound and wrapped helix and shaping said tube into said cylindrical metallic screen so that the nominal internal diameter of the shaped screen is only a few hundredths of a millimeter greater than the nominal outside diameter of said wound and wrapped helix.

2. In a circular waveguide having an inner wall formed by a helically wound insulated metallic wire covered with a wound and wrapped barrier layer, the improvement which comprises a metallic screen about said wound and wrapped helix, said screen being of sufficient longitudinal and transverse rigidity to render the waveguide self supportive and consisting of a metal band formed into a tube with a high frequency weld joining the contiguous edges of the band, which welded tube is shaped about said wound and wrapped helix so that the nominal internal diameter of said screen is only a few hundredths of a millimeter greater than the nominal outside diameter of said wound and wrapped helix.

3. A waveguide according to claim 2 wherein the metal of the metallic screen is a good electrical conductor and has an elastic limit sufficient that a waveguide element as therein defined at a length of from about 10 to 15 meters undergoes no permanent deformation under its own weight when supported at its two ends.

4. A waveguide according to claim 3 wherein said screen is made from hard or semi-hard aluminium having a yield point of at least 7.5 hbars.

5. A waveguide according to claim 3, wherein the thickness e of the screen satisfies the equation:

$$e \geqq \frac{\frac{1}{\pi} \times \frac{\psi}{d}}{\frac{R_\rho}{TC} - \rho}$$

wherein $R_\rho$ is the elastic limit of the screen metal,

C is a safety factor above 1

$T = L^2/2d$ is a characteristic of the screen dimensions $L$ is the manufactured length $d$ is the internal diameter of the screen $\rho$ is the specific mass of the screen metal $\psi$ is the weight of the wound structure per millimeter.

* * * * *